US005217193A

United States Patent [19]

Drucker

[11] Patent Number: 5,217,193

[45] Date of Patent: Jun. 8, 1993

[54] PAINT CAN HOLDER FOR AN ANGLED ROOF

[76] Inventor: Melvin Drucker, 3 Dooley Ct., Dix Hills, N.Y. 11746

[21] Appl. No.: 919,744

[22] Filed: Jul. 27, 1992

Related U.S. Application Data

[63] Continuation-in-part of Ser. No. 852,047, Mar. 16, 1992, abandoned.

[51] Int. Cl.[5] ..... A47G 23/02

[52] U.S. Cl. ..... 248/148; 248/154; 248/311.2

[58] Field of Search ..... 248/148, 149, 172, 154, 248/237, 150, 310, 311.2, 313, 408, 454.7

[56] References Cited

U.S. PATENT DOCUMENTS

| | | | |
|---|---|---|---|
| 1,423,726 | 7/1922 | Mohr | 248/148 |
| 1,615,611 | 1/1927 | Bindon | 248/149 X |
| 1,704,683 | 3/1929 | Buz | 248/155.1 |
| 2,672,742 | 3/1954 | Amberg | 248/145.3 |
| 2,750,139 | 6/1956 | Young | 248/148 |
| 3,191,900 | 6/1965 | Cayot | 248/172 X |
| 3,207,461 | 9/1965 | Holzwarth | 248/145.3 |
| 3,642,239 | 2/1972 | Zeiler | 248/310 X |
| 3,738,601 | 6/1973 | Gehringer | 248/310 X |
| 4,223,859 | 9/1980 | Erickson | 248/154 |
| 4,962,906 | 10/1990 | Fatool | 248/150 |
| 5,071,096 | 12/1991 | Hartman | 248/154 |
| 5,080,437 | 1/1992 | Pesta | 248/408 |

*Primary Examiner*—J. Franklin Foss
*Attorney, Agent, or Firm*—Galgano & Belkin

[57] ABSTRACT

The present invention relates to a paint can holder for use on an angled roof. The paint can holder includes a tray for supporting one of two different sized paint cans, one at a time and void of the need for readjustment when the cans are switched back and forth, mechanisms for retaining either of the paint cans to the tray, so that when either of the paint cans is carried by its handle the holder will travel along with the paint can to another location and legs for stabilizing the tray in a horizontal position on the angled roof, so as to maintain the paint can in a vertical upright position void of counterbalancing weights.

8 Claims, 4 Drawing Sheets

Fig. 4
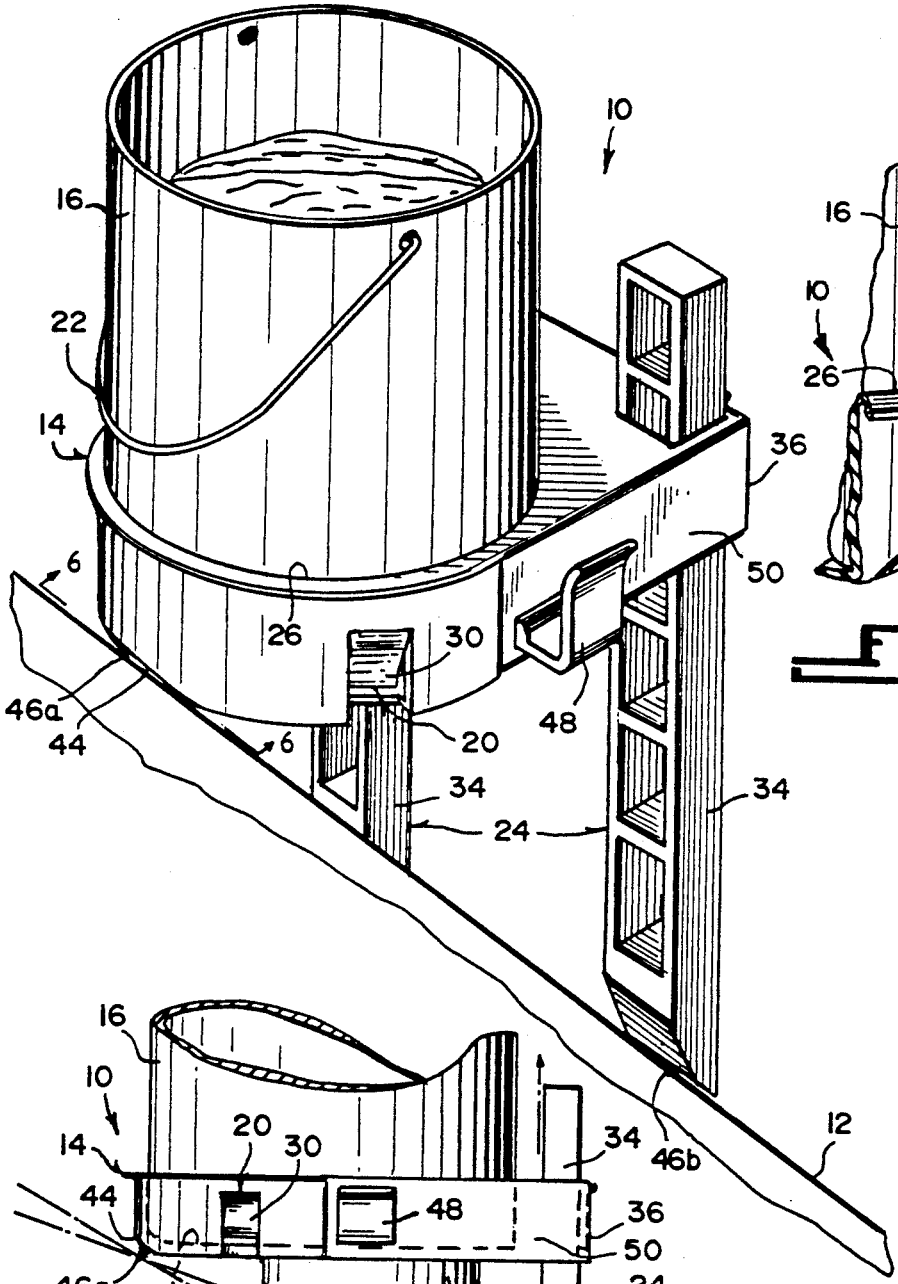
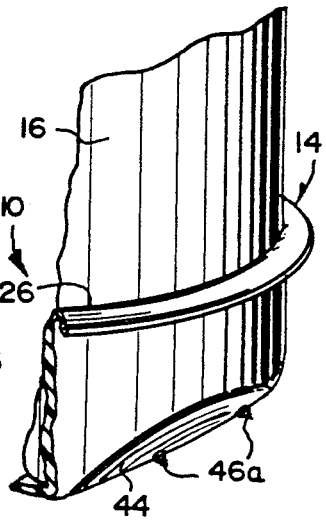
Fig. 6
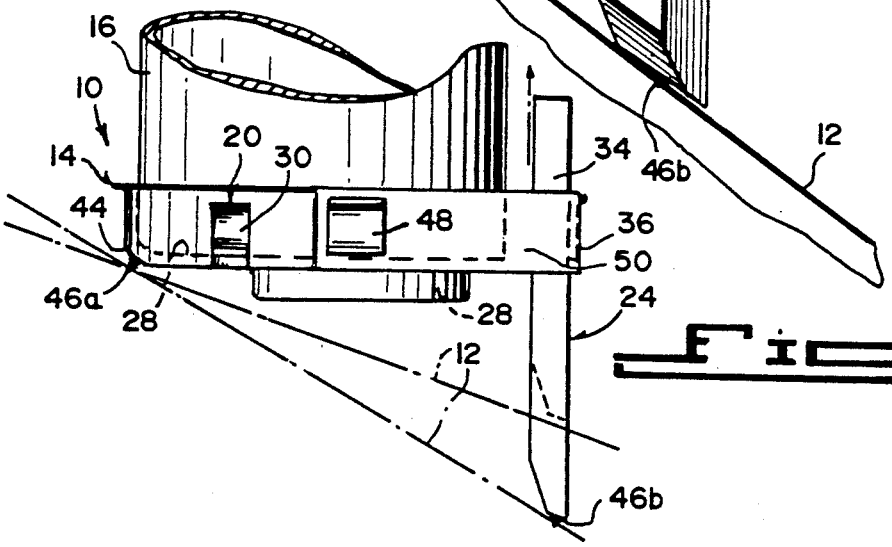
Fig. 5

Fig. 10
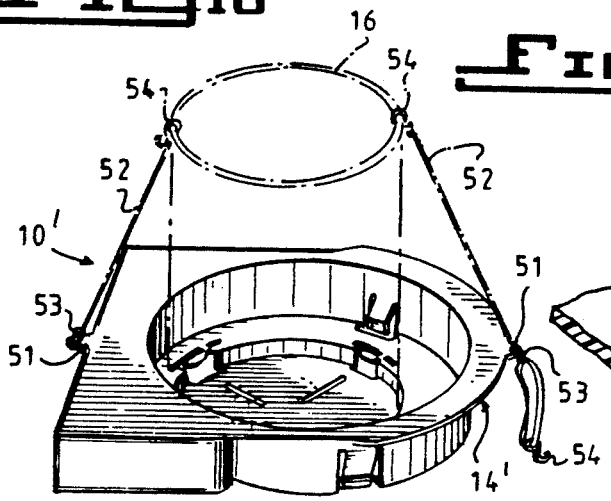
Fig. 11
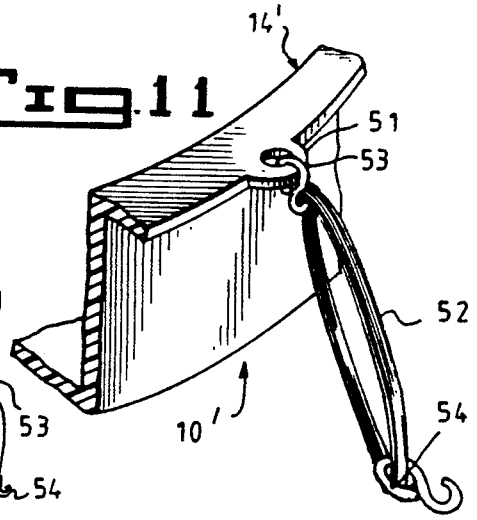
Fig. 12
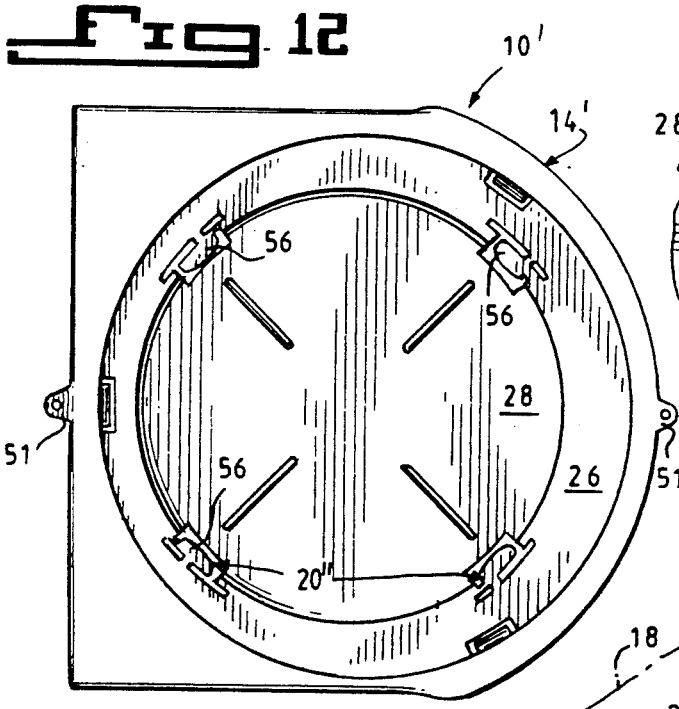
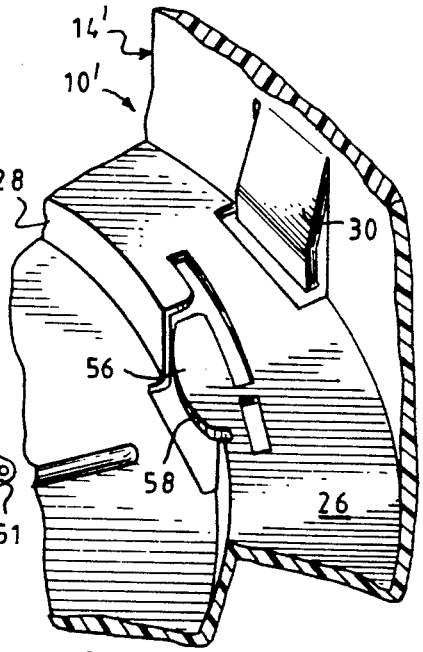
Fig. 13
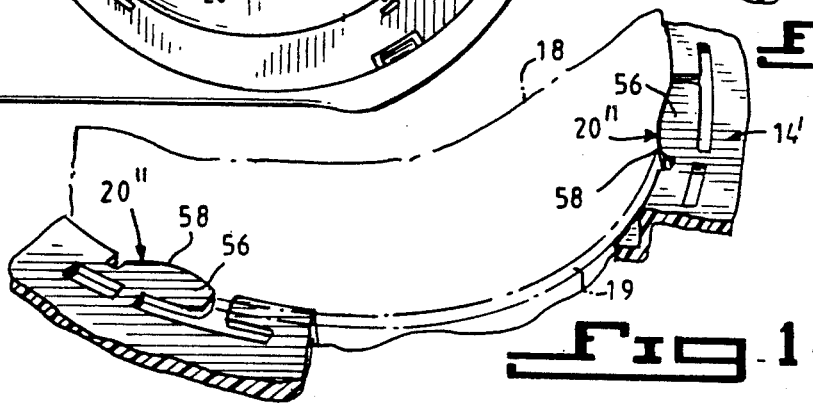
Fig. 14

PAINT CAN HOLDER FOR AN ANGLED ROOF

RELATED APPLICATION

This is a continuation-in-part application of co-pending U.S. patent application Ser. No. 07/852,047, filed Mar. 16, 1991, now abandoned.

BACKGROUND OF THE INVENTION

1. Field of the Invention

The present invention relates generally to paint bucket supports. More specifically, the present invention relates to an improved paint can holder for use on angled roofs.

2. Description of the Prior Art

Numerous innovations for paint can holders have been provided in the prior art that are adapted to be used. Even though these innovations may be suitable for the specific individual purposes to which they address, they would not be suitable for the purposes of the present invention as heretofore described.

For example, U.S. Pat. No. 606,100 to Thompson relates to a combination paint bucket with partitions so that separate paints of various colors may be carried at one time and in which the paint receptacles will always occupy a horizontal position, even when the vessel is resting on an inclined plane.

U.S. Pat. No. 606,100 to Thompson teaches a paint bucket which includes a receptacle having exterior pockets, a series of removable buckets located in the receptacle, sleeves located inside the bucket in opposite corners of the latter and pointed rod held in the sleeves and capable of independent adjustment. These rods are designed to extend at their lower ends below the receptacle.

The patent to Thompson does not teach a first at least one sheet metal screw affixed to the beveled bottom edge of the tray, a second at least one sheet metal screw affixed to the bottom of the one leg, and a third at least one sheet metal screw affixed to the bottom of the other leg, so as to prevent slippage of the tray on the angled roof. It is therefore believed to be evident that the patent to Thompson does not teach the distinctive features of Applicant's invention.

Additionally the patent to Thompson does not teach retaining mechanism to hold in place round paint can buckets of two different sizes and need no adjustments to the retaining mechanism in order for these cans to be secured.

Likewise, the patent to Thompson does not teach at least two hook ended elastic bodies, one of each connected at opposite sides of the tray, that when hooked over the top rim of a paint can creates tension to secure the holder to the bottom of the paint can when the paint can is lifted by its handle.

Also the patent to Thompson does not teach telescopically adjustable legs with flexible tabs which can be locked in fixed positions in order to prevent slippage of these legs an paint flooding the area.

The patent to Thompson teaches that the tool is made of metal while the present invention is made of plastic which eliminates corrosion.

Another example, U.S. Pat. No. 733,984 to Lucas relates to a paint bucket having a supplemental tray to receive and hold the brushes when the brushes are not in use or to hold a different paint from that carried in the main portion of the bucket. A partition creates the separate portions.

The patent to Lucas does not teach a first at least one sheet metal screw affixed to the beveled bottom edge of the tray, a second at least one sheet metal screw affixed to the bottom of the one leg, and a third at least one sheet metal screw affixed to the bottom of the other leg, so as to prevent slippage of the tray on the angled roof. It is therefore believed to be evident that the patent to Lucas does not teach the distinctive features of Applicant's invention.

Also the patent to Lucas does not teach telescopically adjustable legs with flexible tabs which can be locked in fixed positions in order to prevent slippage of these legs an paint flooding the area.

Additionally the patent to Lucas does not teach retaining mechanism to hold in place round paint can buckets of two different sizes and need no adjustments to the retaining mechanisms in order for these cans to be secured.

The patent to Lucas teaches that the tool is made of metal while the present invention is made of plastic which eliminates corrosion.

U.S. Pat. No. 1,061,152 to Winter teaches a device which includes a base having an upwardly turned marginal flange which is formed centrally with an annular row of apertures, and a bottle supporting ring mounted centrally of the base, whereby a space is left between the flange of the base and the ring. The ring has an inwardly extending flange, lugs formed on the free edge of the flange and are adapted to project through the apertures in the base to secure the ring thereto, and a plurality of spring fingers carried by the ring and adapted to engage a bottle.

The patent to Winter does not teach a first at least one sheet metal screw affixed to the beveled bottom edge of the tray, a second at least one sheet metal screw affixed to the bottom of the one leg, and a third at least one sheet metal screw affixed to the bottom of the other leg, so as to prevent slippage of the tray on the angled roof. It is therefore believed to be evident that the patent to Winter does not teach the distinctive features of the present invention.

Additionally the patent to Winter does not teach retaining mechanisms to hold in place round paint can buckets of two different sizes and need no adjustments to the retaining mechanisms in order for these cans to be secured.

Also the patent to Winter does not teach telescopically adjustable legs with flexible tabs which can be locked in fixed positions in order to prevent slippage of these legs an paint flooding the area.

The patent to Winter teaches that the tool is made of metal while the present invention is made of plastic which eliminates corrosion.

Still another example, U.S. Pat. No. 1,193,307 to Sorley relates to a painter's bucket provided with means for supporting the same upon an inclined plane, such as a roof.

U.S. Pat. No. 1,193,307 to Sorley teaches a combination with a bucket of a bracket plate mounted on the bottom of the bucket and provided with a surface engaging edge. It also includes adjustable surface engaging members mounted on the bucket for cooperation with the bracket plate to secure the bucket in an upright position even on an inclined surface, guide means for the adjustable surface engaging members and a spring locking member for the adjustable surface engaging members. The locking member is mounted in the bracket plate. It additionally includes guide means for the locking member and a releasing member for withdrawing the locking member from the adjustable surface engaging member.

The patent to Sorley does not teach a first at least one sheet metal screw affixed to the beveled bottom edge of the tray, a second at least one sheet metal screw affixed to the bottom of the one leg and a third at least one sheet metal screw affixed to the bottom of the other leg, so as to prevent slippage of the tray on the angled roof. It is therefore believed to be evident that the patent to Sorley does not teach the distinctive features of Applicant's invention.

Additionally the patent to Sorley does not teach retaining mechanisms to hold in place round paint can buckets of two different sizes and need no adjustments to the retaining mechanisms in order for these cans to be secured.

The patent to Sorley teaches that the tool is made of metal while the present invention is made of plastic which eliminates corrosion.

Yet still another example, U.S. Pat. No. 1,650,433 to Dages relates to an automatically adjustable base to facilitate the use of paint buckets and other open top containers on roofs and other non-level surfaces.

U.S. Pat. No. 1,650,433 to Dages teaches a support which includes a seat, a toggle frame pivotally connected to said seat. The frame includes pairs of braces pivotally connected to the opposite ends of the seat, pairs of ties pivoted at one end to the braces and pivoted together at their other end with lost motion connectors.

The patent to Dages does not teach a first at least one sheet metal screw affixed to the beveled bottom edge of the tray, a second at least one sheet metal screw affixed to the bottom of the one leg and a third at least one sheet metal screw affixed to the bottom of the other leg, so as to prevent slippage of the tray on the angled roof. It is therefore believed to be evident that the patent to Dages does not teach the distinctive features of Applicant's invention.

Also the patent to Dages does not teach telescopically adjustable legs with flexible tabs which can be locked in fixed positions in order to prevent slippage of these legs an paint flooding the area.

Additionally the patent to Dages does not teach retaining mechanisms to hold in place round paint can buckets of two different sizes and need no adjustments to the retaining mechanisms in order for these cans to be secured.

The patent to Dages teaches that the tool is made of metal while the present invention is made of plastic which eliminates corrosion.

Still yet another example, U.S. Pat. No. 2,837,305 to Andren relates to attachable supports for cans, pails and the like which can readily be attached to a cylindrical or tapered receptacle and which remains securely attached thereto while permitting adjustment for length by the use of only one hand, leaving the workman's other hand free to support or steady the receptacle.

U.S. Pat. No. 2,837,305 to Andren teaches an attachable and detachable leg unit for pails, chimed cans and similar receptacles. The unit includes a tubular member, a relatively narrow lower bracket supported by the member adjacent its lower end for engaging the bottom edge of a receptacle, the lower bracket extending substantially radially from the tubular member and having at least three upwardly extending lugs thereon for engaging the bottom rim of a receptacle, the lugs being at different radial distances from the tubular member. It also includes a leg telescopically mounted in, and normally protruding from, the bottom end of the member, an upper bracket supported by the member adjacent its upper end for engaging the top edge of the receptacle, the upper bracket extending substantially radially from the tubular member and having a downwardly extending lug thereon for engaging the inner edge of the top rim of a receptacle, and means mounted on one of the brackets for adjustably securing the one bracket relatively to the tubular member, so that the distance between the brackets may be increased or decreased. The mounting means are independent of the fixing means, the other of the brackets are being fixed on the tubular member.

The patent to Andren does not teach a first at least one sheet metal screw affixed to the beveled bottom edge of the tray, a second at least one sheet metal screw affixed to the bottom of the one leg and a third at least one sheet metal screw affixed to the bottom of the other leg, so as to prevent slippage of the tray on the angled roof. It is therefore believed to be evident that the patent to Andren does not teach the distinctive features of the Applicant's invention.

Additionally the patent to Andren does not teach retaining mechanisms to hold in place round paint can buckets of two different sizes and need no adjustments to the retaining mechanisms in order for these cans to be secured.

Also the patent to Andren does not teach telescopically adjustable legs with flexible tabs which can be locked in fixed positions in order to prevent slippage of these legs an paint flooding the area.

The patent to Andren teaches that the tool is made of metal while the present invention is made of plastic which eliminates corrosion.

Yet still another example, U.S. Pat. No. 3,738,601 to Gehringer relates to a paint pot holder that is attachable to a ladder so that the paint can is in front of a painter for convenient use.

U.S. Pat. No. 3,738,601 to Gehringer teaches, in a paint pot holder, the combination of a tray, a pair of hook means and a brace for support to a ladder, the tray including a central depression, a peripheral depression around said central depression and upstanding peripheral walls around the depressions, the central depression being adaptable to hold a quart size paint can and the peripheral depression being adaptable to hold a gallon size paint can. The central depression has a bottom which is lower than a bottom of the peripheral depression, whereby a peripheral underside area of said gallon size paint can is rested on the peripheral depression bottom for stability against tipping. The hook means include a pair of upstanding bars secured to a rear of the tray, the upper ends of the bars being turned into hooks for support to a rung of the ladder, the brace being attachable at one end to a bracket on an underside of the tray, the other end of the brace having a notch for resting against a lower rung of the ladder.

The patent to Gehringer does not teach a first at least one sheet metal screw affixed to the beveled bottom edge of the tray, a second at least one sheet metal screw affixed to the bottom of the one leg, and a third at least one sheet metal screw affixed to the bottom of the other leg, so as to prevent slippage of the tray on the angled roof. It is therefore believed to be evident that the patent to Gehringer does not teach the distinctive features of the Applicant's invention.

Also the patent to Gehringer does not teach telescopically adjustable leg with flexible tabs which can be locked in fixed positions in order to prevent slippage of these legs an paint flooding the area.

The patent to Gehringer teaches that the tool is made of metal while the present invention is made of plastic which eliminates corrosion.

Another example, U.S. Pat. No. 4,702,446 to Brown relates to a ladder caddy that allows a pail of paint to set, rather than hang, in an accessible and secure position to the outside of a hollow rung extension ladder while painting at higher heights.

U.S. Pat. No. 4,702,446 to Brown teaches a ladder caddy for connecting, generally but not limited to, a pail of paint, stain or other such substance to a ladder having hollow rungs and utilizing the hollow portion of one of the rungs to position the pail to the side of the ladder. The ladder caddy includes a holding arm that enters a hollow run from either side of the ladder and is equipped with two short rubber friction sleeves that surround the holding arm at each extreme end of its exposed surface and a support arm into which is anchored at its top end and at 90 degrees one end of the holding arm and to which on its opposite side is anchored a backboard, the bottom edge of which is flush with the bottom end of the support arm. Additionally, the ladder caddy includes a pail holding band support which is flat on one side and is anchored horizontally to, and across, the midsection of the backboard with the opposite side having a concave portion cut out to a depth of about one-half inch to match the contour of the pail, a narrow sheet metal pair holding band anchored in the concave area of the holding band support and equipped with a cam type lock for compressing the band around the pail and with tool hooks anchored to its outer side, a support rod having two parallel ends and a V-shaped horizontal base, with the parallel ends mounted between the backboard and the pail holding band support upon which horizontal portion of the pail rests when placed within the pail holding band and a sheet metal paint brush retainer, one edge of which is pressure-anchored between the backboard and holding band support and the opposite side bent in the shape of an inverted "V" thus providing additional holding pressure against the side of the brush.

The patent to Brown does not teach a first at least one sheet metal screw affixed to the beveled bottom edge of the tray, a second at least one sheet metal screw affixed to the bottom of the one leg and a third at least one sheet metal screw affixed to the bottom of the other leg, so as to prevent slippage of the tray on the angled roof. It is therefore believed to be evident that the patent to Brown does not teach the distinctive features of the Applicant's invention.

Also the patent to Brown does not teach telescopically adjustable legs with flexible tabs which can be locked in fixed positions in order to prevent slippage of these legs an paint flooding the area.

The patent to Brown teaches that the tool is made of metal while the present invention is made of plastic which eliminates corrosion.

Yet another example, U.S. Pat. No. 3,980,264 to Tomasik relates to a paint can and accessory holder which can be removably secured to a ladder and which lends positive assurance to the painter that an open can will not be tipped or dislodged from the ladder during painting.

U.S. Pat. No. 3,980,264 to Tomasik teaches a paint can and accessory holder which includes, in combination, a base for supporting a paint can, the base including a support mount disposed generally horizontally and having fixedly secured thereon a generally flat tray sized and shaped to receive the paint can. The support mount is elongated and has its ends extending beyond the tray, an accessory tray underlying the support mount and has its ends extending beyond the tray, an accessory tray underlying the support mount and has a lip swingably securable to one end thereof. Additionally, it has means for swingably securing together the lip of the accessory tray and the one end of the support mount, the other end of the support mount being a bifurcated, elongated, vertical member having its lower end sized and shaped to fit within the bifurcated support mount end and being removably securable thereto, stop means carried by the support mount for abutment by said lower end of the vertical member, so that the vertical member is disposed at a 90 degree angle with the support mount, means for removably securing together said bifurcated support mount end and the lower end of said vertical member, an elongated upper cross-arm removably securable along its mid-portion to the upper end of the vertical member, means for removably securing together the mid-portion of the upper cross-arm to the upper end of said vertical member, the upper cross-arm being horizontally disposed and generally vertically juxtaposed over the support mount, so that one end of the cross-arm terminates at a location approximately over the center of the tray, means carried by the one end of the cross-arm for holding a paint brush or the like and clamping means removably secured to the other end of the cross-arm for releasably gripping a ladder or other fixed structural member.

The patent to Tomasik does not teach a first at least one sheet metal screw affixed to the beveled bottom edge of the tray, a second at least one sheet metal screw affixed to the bottom of the one leg and a third at least one sheet metal screw affixed to the bottom of the other leg, so as to prevent slippage of the tray on the angled roof. It is therefore believed to be evident that the patent to Tomasik does not teach the distinctive features of the applicant's invention.

Also the patent to Tomasik does not teach telescopically adjustable legs with flexible tabs which can be locked in fixed positions in order to prevent slippage of these legs an paint flooding the area.

The patent to Tomasik teaches that the tool is made of metal while the present invention is made of plastic which eliminates corrosion.

SUMMARY OF THE INVENTION

Accordingly, it is an object of the present invention to provide an improved paint can holder for an angled roof that will overcome the shortcomings of the previously discussed prior art devices.

More particularly, it is an object of the present invention to provide an improved paint can holder for an angled roof that will always maintain a paint can at a vertical upright stabilized position on different angled pitched roofs.

An additional object of the present invention is to provide an improved paint can holder for an angled roof that will support either a large paint can or a small paint can therein, so that when the paint can is lifted up the holder will travel along with the paint can to another location.

A further object of the present invention is to provide an improved paint can holder for an angled roof that is simple and easy to use.

A still further object of the present invention is to provide an improved paint can holder for an angled roof that is economical in cost to manufacture.

In keeping with these objects, and with others which will become apparent hereinafter, one feature of the present invention resides, briefly stated, in a paint can holder for use on an angled roof, including a tray for supporting one of two different sized paint cans one at a time and void of the need for readjustment when the cans are switched back and forth wherein means for retaining either of the paint cans to the tray is provided.

When the improved paint can holder for an angled roof is designed in accordance with the present invention and when either of the paint cans is carried by its handle the holder will travel along with the paint can to another location, means are provided for stabilizing the tray in a horizontal position on the angled roof, so as to maintain the paint can in a vertical upright position and the device is void of counterbalancing weights.

In accordance with another feature of the present invention, the tray has a large well and a small well within the large well, whereby the large well will support the large paint can therein, while the small well will support the small paint can therein.

Another feature of the present invention is that a first retaining mechanism includes a large spring member affixed to the tray and extending into the large well to retain the large paint can, while a second retaining mechanism includes a small flexible knob member affixed to the tray and extending into the small well to retain the small paint can.

Still another feature of the present invention is that secondary retaining means are provided which includes two elastic bodies with hooks on the ends connected to opposite sides of the tray. When hooked over the top rim of the large or small paint can, they create tension to secure either a large or small paint can to the holder.

Yet another feature of the present invention is that the stabilizing means includes two non-telescopically adjustable legs which are void of lips, each being slideable within one corner of the tray, and means for locking the legs in height adjustable positions within the tray, so as to keep the tray in the horizontal position on the angled roof.

Still another feature of the present invention is that the locking means for the legs include that each of the legs has a plurality of spaced apart slots and the tray has a flexible tab on each corner to engage with one of the slots in each of the legs, so as to retain the legs in their height adjustment positions.

Yet still another feature of the present invention is that it further includes that the tray has a beveled bottom edge opposite from the legs, a first at least one sheet metal screw affixed to the beveled bottom edge of the tray, a second at least one sheet metal screw affixed to the bottom of the leg and a third at least one sheet metal screw affixed to the bottom of the other leg, so as to prevent slippage of the holder o the angled roof.

Still yet another feature of the present invention is that it further includes a pair of hook members, each affixed to an opposite side of the tray so that each of the hook members will retain one leg for storage when the leg is removed from the tray.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

BRIEF DESCRIPTION OF THE DRAWING

FIG. 4 is a rear perspective view of the present invention holding a large paint can in a vertical position on an angled roof;

FIG. 5 is a side view thereof showing how the adjustable leg at different heights can compensate for different angled roofs;

FIG. 6 is a perspective view of a portion of the tray showing the at least one sheet metal screw in greater detail;

FIG. 10 is a perspective view of an alternate embodiment of the invention, showing in phantom line a can additionally retained by elastic retention means;

FIG. 11 is an enlarged, fragmentarily-illustrated perspective view of the elastic retention means shown in FIG. 10;

FIG. 12 is a plan view of the tray shown in FIG. 10;

FIG. 13 is an enlarged, fragmentarily-illustrated perspective view of the tray's bottom rim resilient retention means; and FIG. 14 is an enlarged, fragmentarily-illustrated perspective view comparable to FIG. 13 showing the bottom rim of a can (in phantom line) being held by the retention means.

LIST OF REFERENCE NUMERALS UTILIZED IN THE DRAWING

10 - improved paint can holder

12 - angled roof

Figure 1:
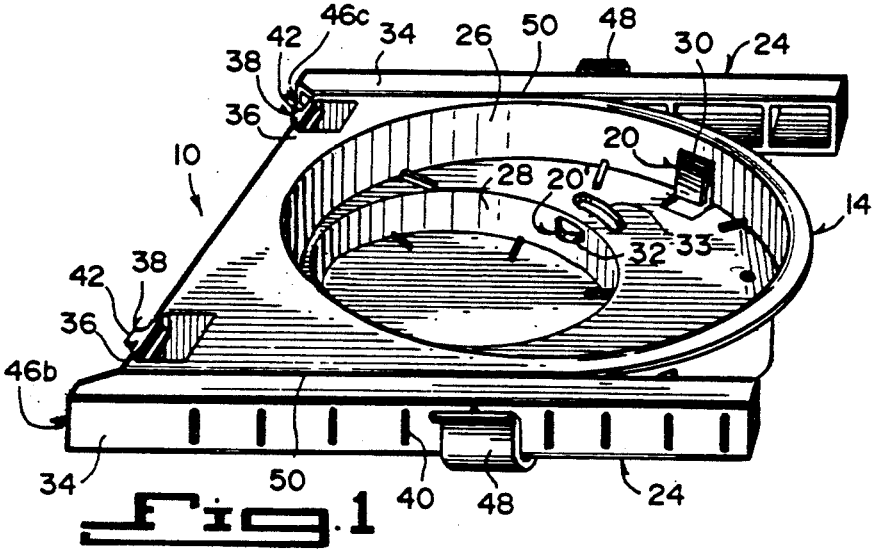
FIG. 1 is a perspective view of the present invention in its stored position.
Figure 3:
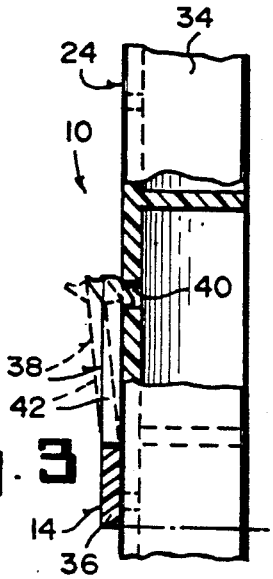
FIG. 3 is a cross sectional view taken along line 3—3 in FIG. 2.
Figure 2:
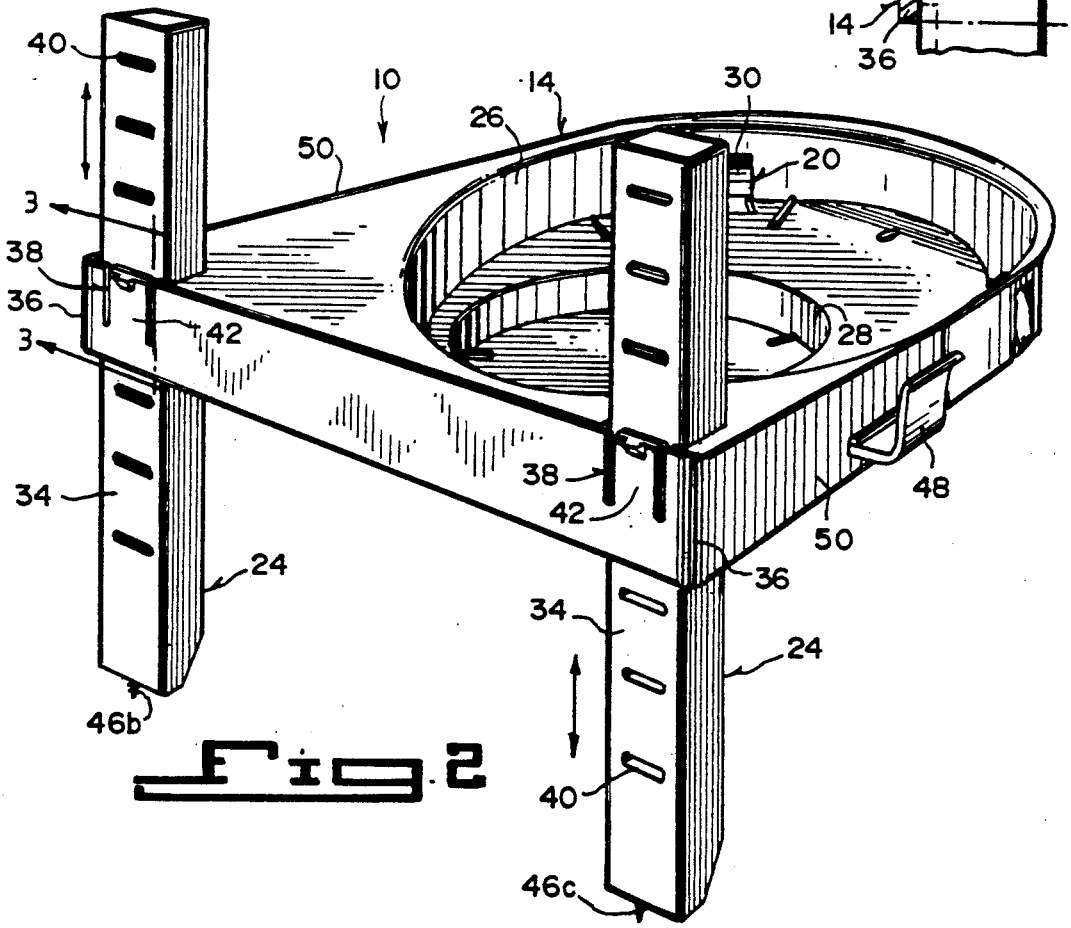
FIG. 2 is a front perspective view of the present invention in its useable position.
Figure 7:
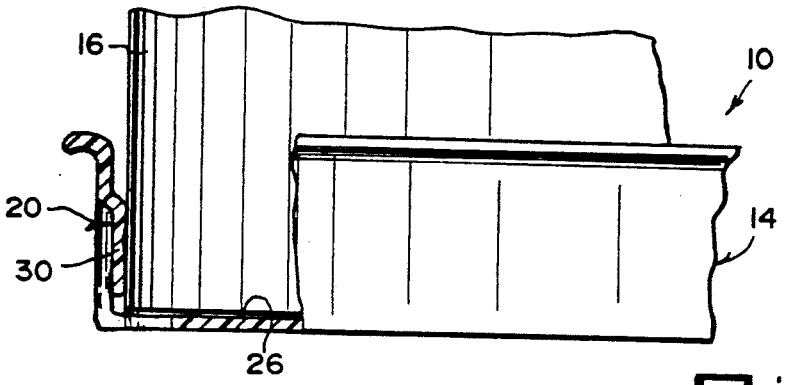
FIG. 7 is a side view of the tray with parts broken away showing the large spring member in greater detail.
Figure 8:
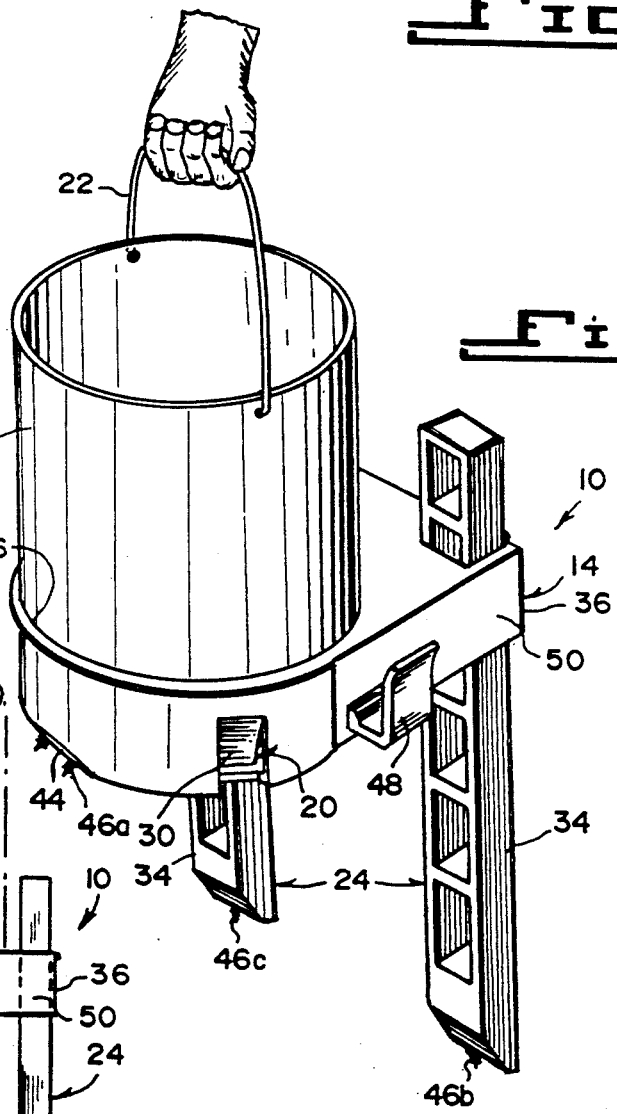
FIG. 8 is a rear perspective view of the present invention in which the holder is being carried along with the large paint can.
Figure 9:
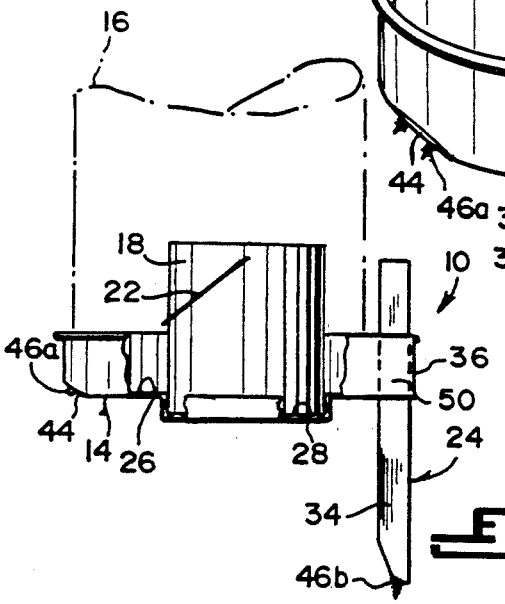
FIG. 9 is a side view with parts broken away showing how a large paint can in phantom is carried in the tray and how a small paint can is carried in the tray.

14 - tray of the improved paint can holder 10 of the present invention

16 - large paint can

18 - small paint can

20 - first retaining mechanism of the improved paint can holder 10 of the present invention

20' - second retaining mechanism of the improved paint can holder 10 of the present invention

22 - handle on large paint can 16 and small paint can 18

24 - stabilizing mechanism of the improved paint can holder 10 of the present invention

26 - large well in tray 14

28 - small well in tray 14

30 - large spring member for the large paint can 16

32 - small flexible knob member for the small paint can 18

33 - large oblong cutout area behind the knob member 32

34 - adjustable leg of the improved paint can holder 10 of the present invention 36 - corner of tray 14

38 - locking mechanism of the improved paint can holder 10 of the present invention 40 - slot in adjustable leg 34

42 - flexible tab on corner 36

44 - beveled bottom edge of tray 14

46*a* - first at least one sheet metal screw

46*b* - second at least one sheet metal screw

46*c* - third at least one sheet metal screw

48 - hook member

50 - side of tray 14

DETAILED DESCRIPTION OF THE PREFERRED EMBODIMENT

Turning now descriptively to the drawings, in which similar reference characters denote similar elements throughout the several views, the FIGURES illustrate an improved paint can holder 10 for an angled roof 12 consisting of a tray 14 for supporting one of two different sized paint cans 16 and 18. A first retaining mechanism 20 is for retaining the large paint can 16 to the tray 14, while a second retaining mechanism 20' is for retaining the small paint can 18 to the tray 14, so that when either of the paint cans is carried by its handle 22 the holder 10 of the Applicant's invention will travel along with the paint can to another location.

Another mechanism 24 is for stabilizing the tray 14 in a horizontal position on the angled roof 12, so as to maintain the paint can 16 or 18 in a vertical upright position.

The tray 14 has a large well 26 and a small well 28 within the large well 26. The large well 26 will support the large paint can 16 therein, while the small well 28 will support the small paint can 18 therein.

The first retaining mechanism 20 includes a large spring member 30 affixed to the tray 14 and extending into the large well 26 to retain the large paint can 16. The second retaining mechanism 20' includes a small flexible knob member 32 affixed to the tray 14 and extending into the small well 28. The tray 14 has a large oblong cutout area 33 behind the knob member 32 to allow the knob member 32 to flex to retain the small paint can 18.

The stabilizing mechanism 24 includes two adjustable legs 34, each slideable within one corner 36 of the tray 14. A mechanism 38 is for locking the legs 34 in height adjustable positions within the tray 14, so as to keep the tray 14 in a horizontal position on the angled roof 12.

The locking mechanism 38 for the legs 34 includes each leg having a plurality of spaced apart slots 40. The tray 14 has a flexible tab 42 on each corner 36 to engage with one of the slots 40 in each leg 34, so as to retain the legs 34 in their height adjustable positions.

The tray 14 has a beveled bottom edge 44 opposite from the legs 34. A first at least one sheet metal screw 46*a* is affixed to the beveled bottom edge 44 of the tray 14. A second at least one sheet metal screw 46*b* is affixed to the bottom of one leg 34, while a third at least one sheet metal screw 46*c* is affixed to the bottom of the other leg 34, so as to prevent slippage of the holder 10 of the Applicant's invention on the angled roof 12.

The holder 10 of the present invention further includes a pair of hook members 48. Each hook member 48 is affixed to an opposite side 50 of the tray, so that each hook member 48 will retain one leg 34 for storage when the leg 34 is removed from the tray 14, as shown in FIG. 1.

FIGS. 10–14 illustrate certain preferred features of the invention. In particular, the paint can holder 10' of FIG. 10 is similar to that of FIG. 1 in that it also has a tray 14' for supporting one of two different sized paint cans 16 and 18. The first retaining mechanism 20 is the same but the second retaining mechanism 20'' has been modified and additional elastic strips or bands 52 are provided to secure the cans 16, 18 to the tray 14'.

As seen best in FIGS. 10–12, tray 14' is provided with two eyelets 51 on opposite sides thereof to each of which is permanently attached a hook 53 affixed to one end portion of an elastic band 52. An additional hook 5 is affixed to the opposite end of the elastic band which, in turn, and upon stretching of the band 52, may be secured to the open rim of the can to better secure its place when in use, under elastic tension of the band 52.

As seen best in FIGS. 12–14, the second retaining mechanism 20'' for retaining the small paint can 18 in the well 28 of tray 14' has been modified and consists of four-radially spaced apart, horizontally disposed, cantilevered, fingers or flanges 56, each having a radially inwardly-extending rounded edge 58 disposed adjacent the top of the well 28 which is intended to fit over the bottom rim 19 of the small paint can when the same is retained in the well 28 of the tray 14'. When the paint can 18 is inserted into the well 28, the bottom rim 19 of the can 18 will strike the inner edge 58 of the finger 56 causing it to resiliently deflect outwardly and downwardly, thereby permitting can 18 to become seated in the well 28 of the tray 14', with the finger 56 then snapping back into place above the rim, thereby releasably locking the can 18 in the tray 14'. However, the can 18 can easily be released upon upward pulling of the can 18 with sufficient force to cause upward and outward flexing of the finger 56 so as to enable escape of the bottom rim 19 of the can from underneath the inner edge 58 of finger 56.

It will be understood that each of the elements described above, or two or more together, may also find a useful application in other types of constructions differing from the type described above.

While the invention has been illustrated and described as embodied in an improved paint can holder for an angled roof, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A paint can holder for use on an angled roof, comprising:

a tray for supporting one of two differently-sized paint cans, said tray including a large well for supporting a large paint can on said tray so as to prevent the large paint can from tipping over and a small well disposed within said large well for supporting a small paint can on said tray so as to prevent the small paint can from tipping over;

first spring-like retaining means for releasably and resiliently retaining a large paint can in said large well of said tray, said first retaining means resiliently engaging the bottom rim of the large paint can when the large paint can is inserted into said large well so that when the paint can is carried by its handle to another location, said tray means is transported therewith;

a second spring-like retaining means for releasably and resiliently retaining the small paint can in said small well of said tray, said second retaining means resiliently engaging the bottom rim of the small paint can when the small paint can is inserted into said small well so that when the paint can is carried by its handle to another location, said tray means is transported therewith;

a pair of adjustable legs slidably mounted on said tray for horizontally orientating said tray on an angled roof so that the paint can is held in a stable vertical orientation; and locking means for locking said legs relative to said tray when said tray is horizontally orientated on the angled roof.

2. The improved paint can holder of claim 1, wherein said first retaining means includes a plurality of downwardly and inwardly extending spring members affixed to and spaced about said first well.

3. The improved paint can holder of claim 1, wherein said second retaining means for releasably retaining the small paint can comprises a plurality of spaced-apart, horizontally disposed and cantilevered resilient fingers having an inner edge which extends radially inwardly of said small well.

4. The improved paint can holder of claim 1, additionally including a third means for retaining the large and small cans, said wells of said tray comprising a plurality of elastic bands, each having one end portion to which a hook-like element is affixed which, upon stretching of said band, may be hooked over the open rim of the can to resiliently hold the same in place in said wells of said tray.

5. The improved paint can holder of claim 1, wherein said tray has a pair of spaced apart holes in which said legs are slidably mounted, and wherein said locking means for said legs includes a plurality of spaced apart slots formed in each of said legs and a pair of flexible tabs mounted on the tray, each tab being engagable with said spaced apart slots in one of said legs, so as to lock said leg relative to said tray when said tray is horizontally oriented on the angled roof.

6. The improved paint can holder of claim 5, wherein said tray has a bottom edge portion disposed opposite from said pair of adjustable legs, at least one screw affixed to said bottom edge portion of said tray for fixedly securing said tray to the angled roof, and at least one screw affixed the bottom of each of said adjustable legs for fixedly securing said legs to the angled roof.

7. The improved paint can holder of claim 6, further including a pair of hook members, each affixed to said tray for storing one of said adjustable leg when said legs are slidably removed from said tray.

8. The improved paint can holder of claim 1, wherein said tray is made of plastic.

* * * * *